US008191718B2

(12) United States Patent
Hovatter

(10) Patent No.: US 8,191,718 B2
(45) Date of Patent: Jun. 5, 2012

(54) RACK MODULES

(75) Inventor: Kenneth R. Hovatter, Acampo, CA (US)

(73) Assignee: Scientific Specialties, Inc., Lodi, CA (US)

( * ) Notice: Subject to any disclaimer, the term of this patent is extended or adjusted under 35 U.S.C. 154(b) by 138 days.

(21) Appl. No.: 12/287,529

(22) Filed: Oct. 9, 2008

(65) Prior Publication Data

US 2010/0089850 A1 Apr. 15, 2010

(51) Int. Cl.
*A47G 29/00* (2006.01)

(52) U.S. Cl. ..... 211/85.18; 211/70; 211/78; 220/23.6; 206/504

(58) Field of Classification Search ..... 211/70, 211/78, 10, 85.13, 65, 69, 69.1, 70.3, 70.7, 211/95, 163, 164, 85.18; 206/503, 504, 512; 220/4.26, 4.27, 23.6, 507
See application file for complete search history.

(56) References Cited

U.S. PATENT DOCUMENTS

| | | | | | |
|---|---|---|---|---|---|
| 2,364,007 | A | * | 11/1944 | Stanton | 312/216 |
| 3,341,053 | A | * | 9/1967 | Keene | 220/517 |
| 3,554,384 | A | * | 1/1971 | DeNatale | 211/194 |
| 4,095,698 | A | * | 6/1978 | Wright | 211/126.1 |
| 4,253,830 | A | * | 3/1981 | Kazen et al. | 433/77 |
| 4,671,405 | A | * | 6/1987 | Hagan | 206/139 |
| 4,938,369 | A | * | 7/1990 | Carilli | 211/74 |
| 4,971,209 | A | * | 11/1990 | Todd | 211/74 |
| 5,036,989 | A | | 8/1991 | Carilli | |
| 5,261,208 | A | * | 11/1993 | Lockhart | 53/398 |
| 5,271,515 | A | * | 12/1993 | Berkheimer et al. | 220/4.27 |
| 6,047,827 | A | * | 4/2000 | Huang | 206/379 |
| 6,386,381 | B2 | * | 5/2002 | Csiszar | 220/4.03 |
| 2005/0150808 | A1 | * | 7/2005 | Sarna et al. | 206/562 |
| 2006/0049075 | A1 | * | 3/2006 | Chen | 206/504 |
| 2007/0163973 | A1 | * | 7/2007 | Smokowicz et al. | 211/70 |
| 2009/0090647 | A1 | * | 4/2009 | Panchal et al. | 206/504 |

OTHER PUBLICATIONS http://www.heathrowscientific.com/catalog/product?deptId=TUBE+RACKS&prodId=29040A on May 19, 2010.

* cited by examiner

*Primary Examiner* — Darnell Jayne
*Assistant Examiner* — Stanton L Krycinski
(74) *Attorney, Agent, or Firm* — Carr & Ferrell LLP

(57) ABSTRACT

Various aspects include a rack module comprising a side including one or more receptacles. A receptacle may include a contact surface shaped to receive a container. A rack module may include one or more engagement features operable to removably attach the rack module to another rack module having complementary engagement features. The other rack module may also have a side including one or more receptacles, and the attached rack modules may commonly orient their respective receptacles such that the containers received therein may be used.

21 Claims, 11 Drawing Sheets

400
410
420
430
440
450
460
462
470
480
490
FIG. 4A TOP VIEW
FRONT SIDE VIEW

BACK SIDE VIEW

LEFT SIDE VIEW

RIGHT SIDE VIEW

FIG. 4F BOTTOM VIEW

SECTION E-E

RACK MODULES

BACKGROUND

1. Field of Invention

The present application relates generally to devices for receiving and holding containers, and more particularly to racks and rack modules.

2. Description of Related Art

Various containers are used in laboratory or other experimental work, including beakers, flasks, vials, bottles, and test tubes. Many containers are arranged in arrays, particularly when containers are smaller than a few milliliters in size.

FIG. 1 shows a diagrammatic representation of several types of containers. FIG. 1 includes beaker 100, vial 110 (which in this example, has a conical bottom), and test tube 120. Containers are often oriented for use such that the mouth or opening of the container faces in a direction (usually up) that is appropriate for receiving a sample. Some containers may be sealed or capped or plugged.

Some containers are less than one milliliter, 100 microliters, or even 1 nanoliter in volume. In some cases, arrays of hundreds or even thousands of containers may be arranged in a plate or other conveyance structure. FIG. 1 also shows arrays of containers. Some arrays such as array 130 may include a plurality of containers connected near their openings. Other arrays, such as array 140, may include a plurality of containers that are machined or molded from a solid block. Arrays may also be used to hold discrete containers. Arrays are often characterized by one or more spacings 150 between adjacent containers.

The receipt, arrangement, and support of various containers may involve the use of a rack. Typically, a rack orients a container and/or an array of containers in a way that facilitates their use. Some racks arrange discrete containers in an array. Some racks hold a preformed array of containers, such as a rack that holds a standardized plate (e.g., a microplate, microtiter plate, polymerase chain reactions (PCR) plate and the like). Many racks orient their respective containers such that an opening of the container faces up, ready to receive or provide a fluid. Other racks orient containers in generally horizontal positions (e.g., a wine rack) or angled orientations (e.g., a rack for riddling champagne). Some racks hold containers at a height determined by the requirements of people using the containers or various equipment interacting with the containers. Some racks commonly orient a plurality of containers (e.g., with their openings at the same height).

Many laboratories use a variety of different containers. Most racks are sized to hold a specific type, shape, or size of container (e.g., a test tube rack), and so using different containers often requires using different racks.

Laboratory processes may be improved by standardization. As such, a rack system that may be adapted to a variety of types and numbers of containers may improve efficiency.

SUMMARY OF THE INVENTION

Various embodiments include a rack module comprising a side including one or more receptacles. A receptacle may include a contact surface shaped to receive a container. A rack module may include one or more engagement features operable to removably attach the rack module to another rack module having complementary engagement features. The other rack module may also have a side including one or more receptacles, and the attached rack modules may commonly orient their respective receptacles such that the containers received therein may be used.

Some rack modules may include a partial receptacle. When two attached rack modules each have matching and aligned partial receptacles, the partial receptacles may form a receptacle in the region "between" the receptacles of the respective attached rack modules. In some cases, receptacles are in an array having a spacing, and a receptacle formed from a pair (or more) of partial receptacles is spaced from an element of the array with the same spacing.

Various engagement features may be operated to removably attach a rack module to another rack module having complementary engagement features. Certain embodiments include a rack having two or more rack modules removably attached using their respective engagement features.

A rack for holding a plurality of containers may comprise two or more removably attached rack modules. Each rack module may include a side including one or more receptacles. Some receptacles have a contact surface shaped to receive a container. A rack module may include one or more engagement features operable to removably attach the rack module to another rack module having complementary engagement features. The other attached rack module may also have a side including one or more receptacles, and the attached rack modules may commonly orient their respective receptacles such that the containers received therein may be used. A resulting rack may have a plurality of rack modules, each orienting its respective receptacles in a position such that containers disposed therein may be used.

Some rack modules have receptacles located on different sides. In some cases, the engagement features provide for customization of a rack comprising attached rack modules. Customization may be provided by disengaging an attached rack module, choosing a side having a different receptacle configuration, and reattaching the rack module to the rack. Receptacle configuration may be customized by changing sides (disposed for use, e.g., up) of a rack module. A length of a rack may be changed by adding or removing rack modules.

BRIEF DESCRIPTION OF THE DRAWINGS

FIGS. 4A-4F show six different views of an exemplary embodiment.

DETAILED DESCRIPTION

Various racks and rack modules may receive, orient and/or support containers. Exemplary rack modules may include one or more receptacles, where a receptacle may be shaped to receive a container. Rack modules may include one or more engagement features, and two or more rack modules may be attached together using complementary engagement features.

Racks may be configured to hold a diverse range and/or number of containers by attaching several rack modules in various arrangements. Rack modules may be made from polymers, metals, ceramics, or composites thereof. In some embodiments, a rack module is made from a polymer, such as polyethylene, polypropylene, polycarbonate, PET, PETE, or polystyrene. Some rack modules may be autoclavable.

Figure 1:
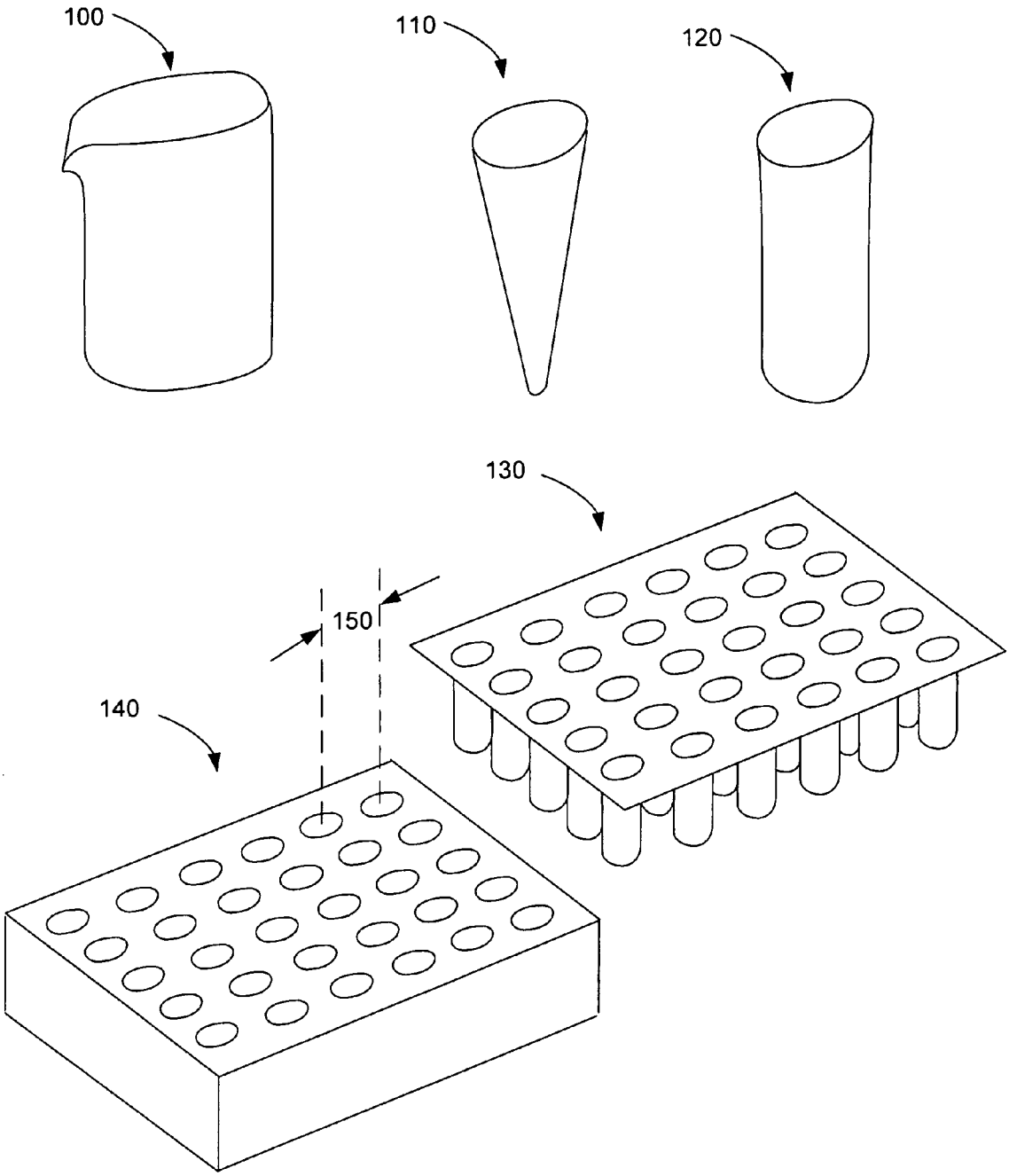
FIG. 1 PRIOR ART
FIG. 1 shows a diagrammatic representation of several types of containers.
Figure 2:
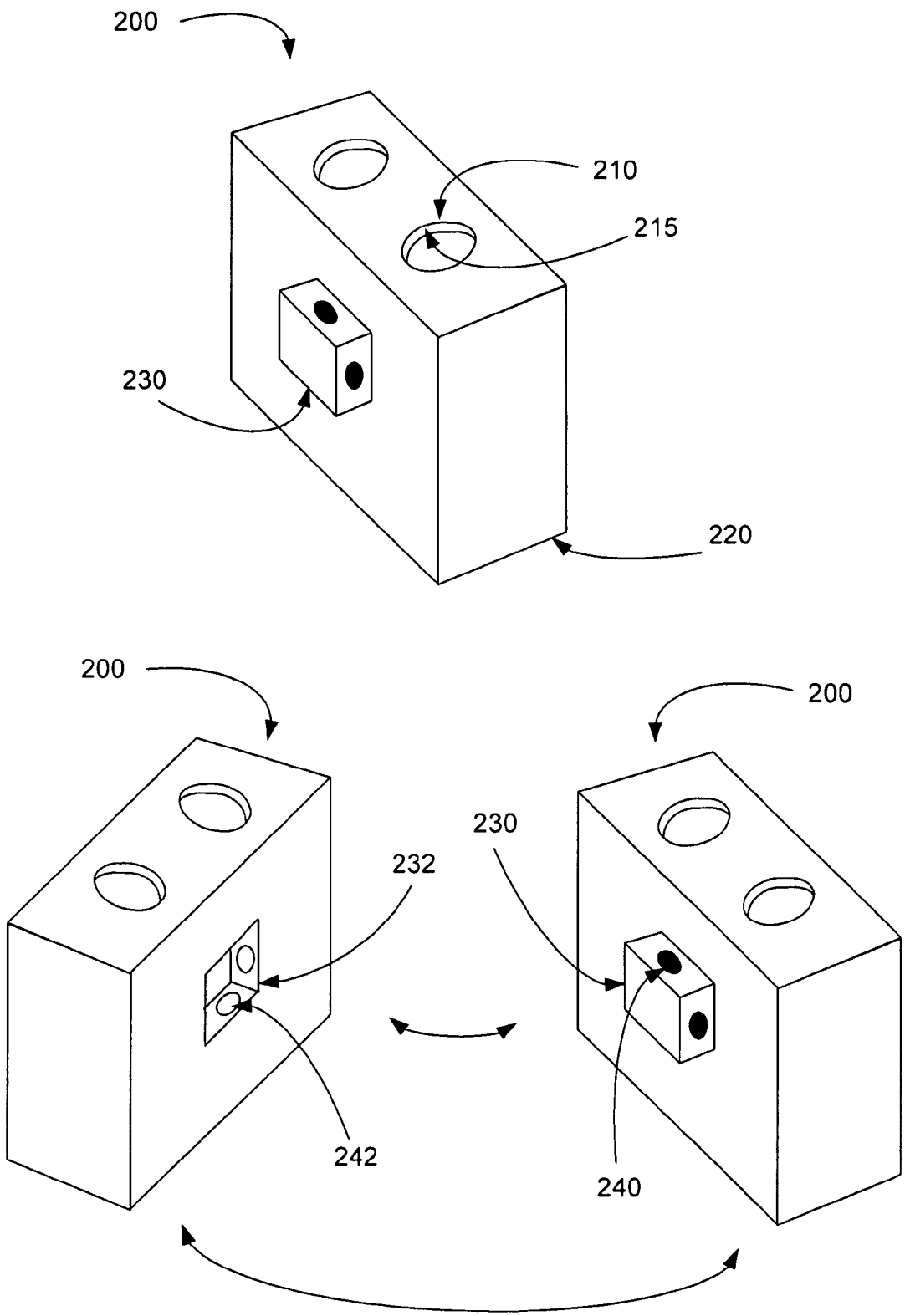
FIG. 2 is a diagrammatic representation of an exemplary rack module, according to certain embodiments.

FIG. 2 is a diagrammatic representation of an exemplary rack module, according to certain embodiments. Rack module 200 includes one or more receptacles 210, each of which is typically shaped or configured to receive, orient and hold one or more containers for use. A receptacle may also be configured to receive, orient and hold a prefabricated plate or other array of containers. A receptacle may have a diameter between about 3 mm and 15 cm. Receptacle 210 may include a contact surface 215, which in some cases may firmly retain a container therein. In some embodiments, contact surface 215 has sufficient area (e.g., length in a direction orthogonal to the side in which the receptacle is disposed) to prevent a received container from wobbling. In some examples, a container is held firmly enough that it does not rotate or spin within the receptacle.

Rack module 200 may include a support structure 220, which may be an inherent feature. In some embodiments, support structure 220 may be ribs, spars, edges, or sides of rack module 200. In other embodiments, support structure 220 may comprise various walls or surfaces of rack module 200. A support structure may be an intrinsic component or set of components of the rack module. A support structure may provide support for a plurality of receptacles, including receptacles whose use requires different orientations of the rack module. A support structure may also provide mechanical integrity to the rack module such that forces used to attach and disengage rack module do not result in damage.

Rack module 200 may include an engagement feature 230. Engagement feature 230 may be used to removably attach the rack module to a matching rack module 200, which typically includes a complementary or matching engagement feature 232. As used herein, removably attached refers to rack modules that may be attached together during use, but that may be separated from each other for other purposes (e.g, cleaning or changing a configuration). In some embodiments, rack modules may be removably attached and disengaged many times (e.g., hundreds, thousands, or even millions of times).

Engagement features may include substructures that improve attachment. In rack module 200, protuberance 240 extends from the surface of engagement feature 230, and fits into a divot 242 of a complementary engagement feature 232. Application of an appropriate attachment force may cause an elastic deformation of these various structures, which relaxes when protuberance 240 "locks into" divot 242. For rack modules fabricated from polymers, protuberance 240 may extend a few millimeters or less (preferably 1 mm or less) above its respective surface, and divot 242 may be a depression or indentation having comparable depth.

Figure 3:
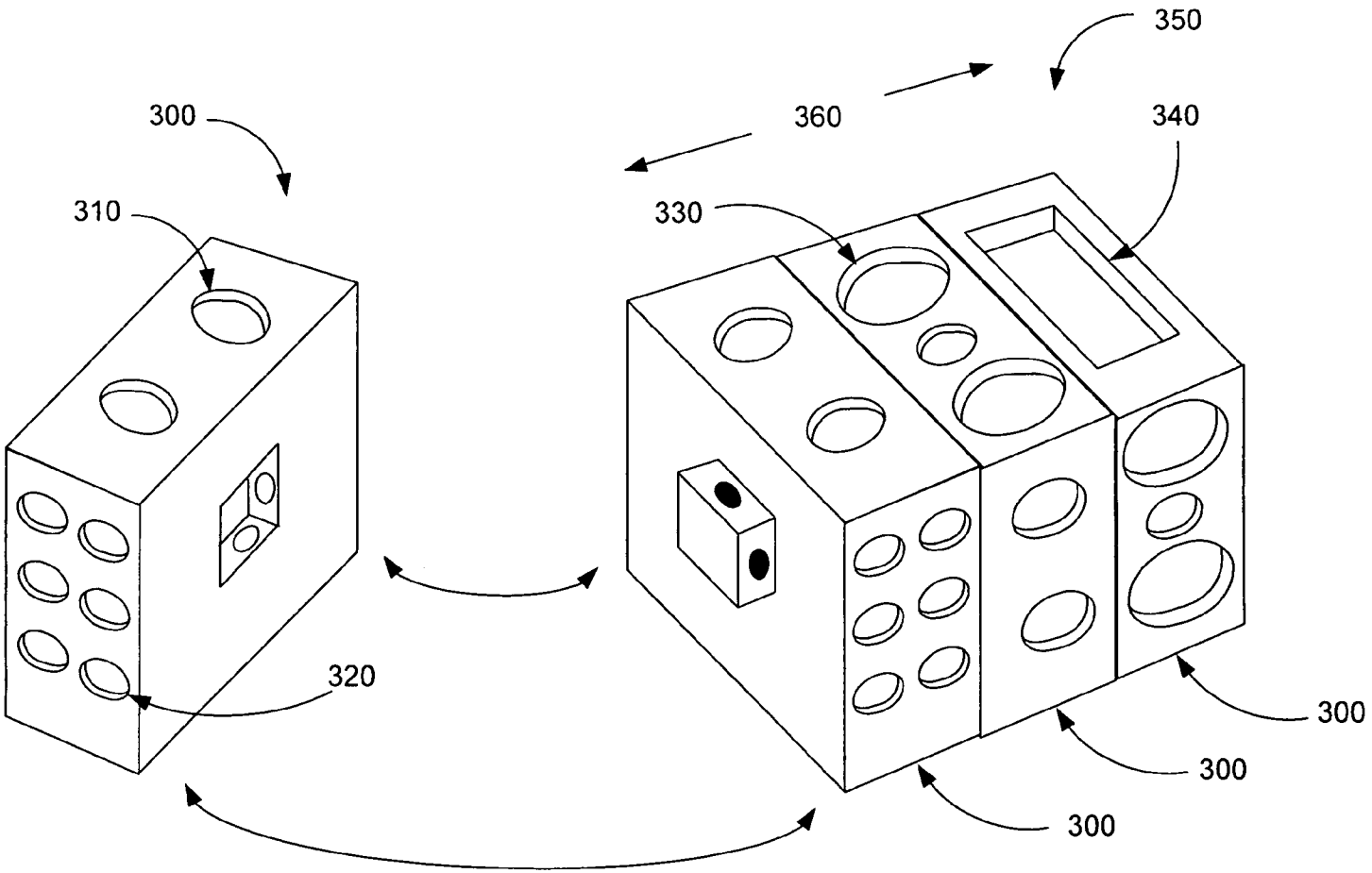
FIG. 3 is a diagrammatic representation of several exemplary rack modules, according to certain embodiments.

FIG. 3 is a diagrammatic representation of several exemplary rack modules, according to certain embodiments. Rack modules 300 include receptacles on several sides, shown as receptacles 310, 320, 330 and 340. Multiple rack modules 300 may be attached to form a rack 350, whose length (e.g., in an attachment direction 360) may be customized by adding or removing rack modules 300. In some embodiments, the receptacles are configured such that containers are supported with their respective openings at similar heights, even when different containers are used in the same rack. In other cases, containers are supported at different heights. The number, size and/or arrangement of receptacles oriented for use (e.g., on the top side of rack 350) may be changed by varying the orientation and/or number of attached rack modules 300.

In some embodiments, engagement features attach one rack module to another rack module. In other embodiments, engagement features attach one rack module to several other rack modules. In some cases, a rack may include a 1-dimensional, 2-dimensional, or even 3-dimensional array of rack modules that are interconnected by their engagement features.

Figures 4B, 4C, 4D, 4E:
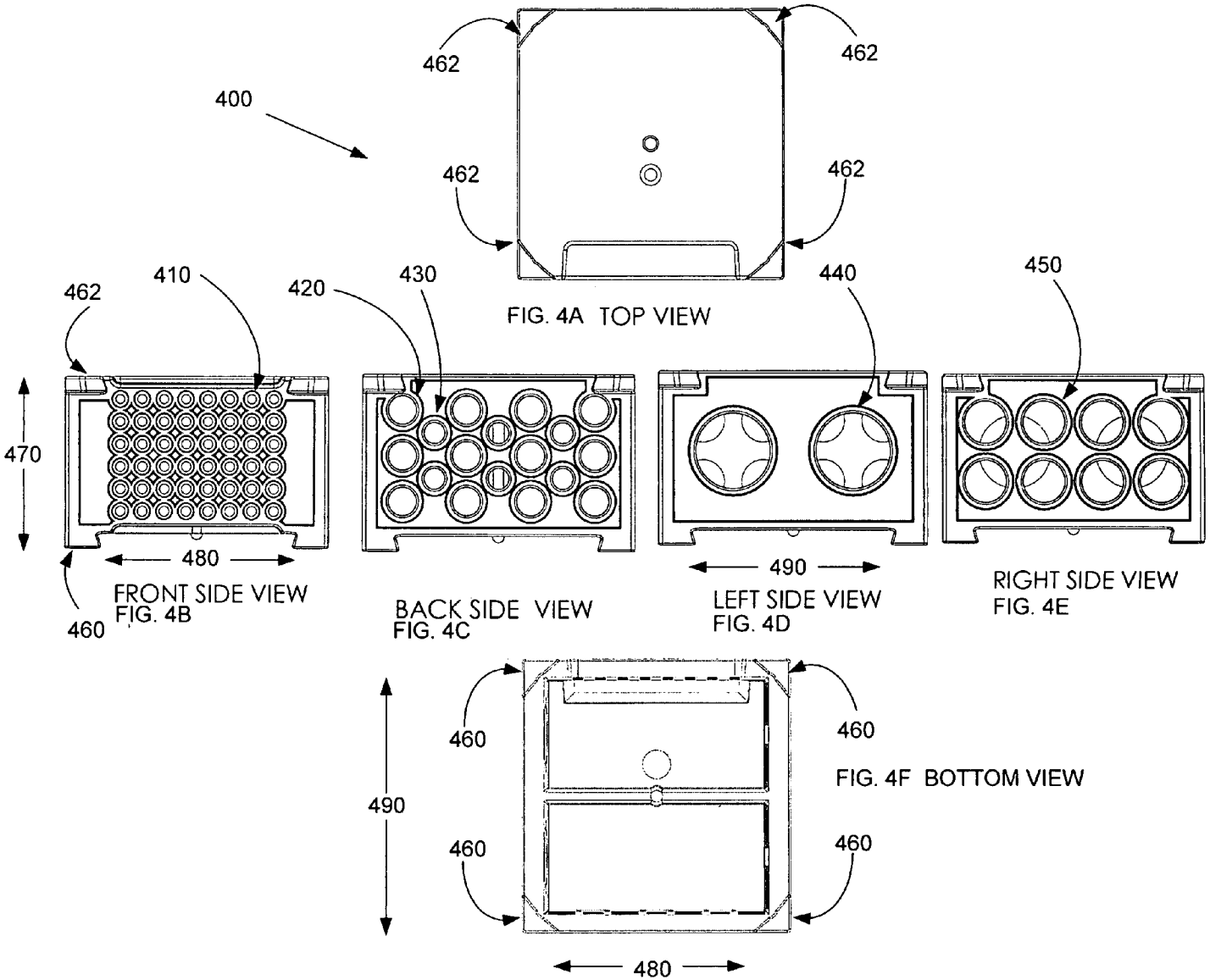

FIGS. 4A-4F show six different views of an exemplary embodiment. Rack module 400 may nominally block-shaped and in some cases, hollow. Rack module 400 may attach to complementary rack modules 400 in a direction 470 approximately normal to the top face (FIG. 4A) and bottom face (FIG. 4F). In this example of a rack module, front (FIG. 4B), back (FIG. 4C), left (FIG. 4D) and right (FIG. 4E) faces each have receptacles configured to receive and hold containers.

In some embodiments, the various faces of rack module 400 are a few inches in length, and receptacles are configured to receive containers having volumes between 1 milliliter and 50 milliliters. Some faces may be configured to receive containers having volumes above 100 milliliters. Other faces may be configured to receive containers having volumes less than 1000 microliters, 100 microliters, or even less than 10 microliters. Other rack modules may be larger (e.g., tens of centimeters on a side or greater), and may be configured to receive containers having volumes of a liter or more.

FIG. 4B shows a front side view of rack module 400, and illustrates an array of receptacles 410 that may be sized to hold containers having volumes less than 1 milliliter. FIG. 4C shows a back side view of rack module 400, and illustrates a configuration having two types of receptacles, each type configured to receive a different size container. Receptacles 420 may be sized to hold a first size of container, and receptacles 430 may be sized to hold a second size of container. FIG. 4D shows a left side view of rack module 400, and illustrates receptacles 440 which may be sized to receive larger containers (e.g., over 30 milliliters). FIG. 4E shows a right side view of rack module 400. FIG. 4E illustrates receptacles 450, which may be sized for test tubes having volumes of a few milliliters. In some embodiments, receptacles may include a contact surface having a shape that is matched to an appropriate container surface large enough to firmly hold the container.

In some embodiments, receptacles are configured in arrays, which may be characterized by one or more spacings, wherein the spacing is between 5 and 25 millimeters (e.g., the space between the center points of two adjacent receptacles). Some arrays may be characterized by 90 degree angles between rows and columns; other arrays may be characterized by other angles.

Rack module 400 includes engagement feature 460, which in the illustrated example includes structures disposed at each of the corners associated with the bottom side (e.g., as shown in FIG. 4F). Each structure of engagement feature 460 fits into a complementary structure in engagement feature 462, on the top side of one or more other rack modules 400 (e.g., as shown in FIG. 4A). Engagement feature 460 and complementary engagement feature 462 may be operated to removably attach a first rack module 400 to a second rack module 400.

According to various exemplary embodiments, one rack module 400 may be attached to another rack module 400 in an attachment direction 470 normal to the top and bottom sides. In some embodiments, an attachment direction may define a direction for a length of attached rack modules, which may correspond to a rack length. In some cases, this length may be adjusted by adding or removing rack modules. For example, a rack may include two, five, ten, twenty, fifty, or more rack modules 400, and a corresponding rack length may be the number of rack modules multiplied by a length associated with rack module 400 in direction 470 (which could be approximately 7 cm in some embodiments).

In some embodiments, an engagement feature may be symmetrical about an axis parallel to an attachment direction (e.g., direction 470). For example, engagement features 460 and 462 may have four-fold symmetry about direction 470. Thus, rack modules may be attached to each other in a variety of rotational configurations, e.g., as determined by the orientation of the receptacle-faces of different rack modules about direction 470. In other embodiments, an engagement feature may be characterized by two-fold symmetry, mirror symmetry, six-fold symmetry, or even eight-fold symmetry. Directions 480 and 490 may be equivalent for symmetry descriptions of some aspects.

In some cases, a pair of removably attached rack modules may be reconfigured by disengaging the rack modules, choosing an alternate orientation (e.g., rotating to a different receptacle-containing side), and re-attaching the rack modules. In some embodiments, an engagement feature prevents motion in a first direction, but allows motion in a second direction (e.g., like a sliding dovetail joint). In other embodiments, an engagement feature prevents motion in a plurality of directions. For example, engagement features 460/462 generally prevent motion in directions 480 and 490. In some cases, engagement features 460/462 allow motion in direction 470, and so adjacent rack modules 400 may be attached (or disengaged) by applying a force in direction 470. In other cases, engagement features 460/462 prevent substantially all lateral displacement of one rack module with respect to an adjacent attached rack module (e.g., lateral displacement in directions 470, 480, 490 and vector combinations thereof wherein an angular relationship between vectors normal to the first and second sides of the rack module is between about 20 and 180 degrees). In such cases, disengagement may include a rotational displacement (e.g., about direction 470) of one rack module vs. the adjacent rack module. In some cases, disengagement (and/or attachment) includes the application of a torque to a first rack module with respect to an attached rack module, (e.g., about direction 470). In some embodiments, an engagement feature may include one or more dovetails, and may prevent displacement (e.g., disengagement) in a typical direction associated with the dovetail geometry. In some cases, a dovetail may have a more complex geometry that prevents lateral motion in several orthogonal directions (e.g., as is the case for engagement feature 460).

Figures 5A, 5B, 5C, 5D:
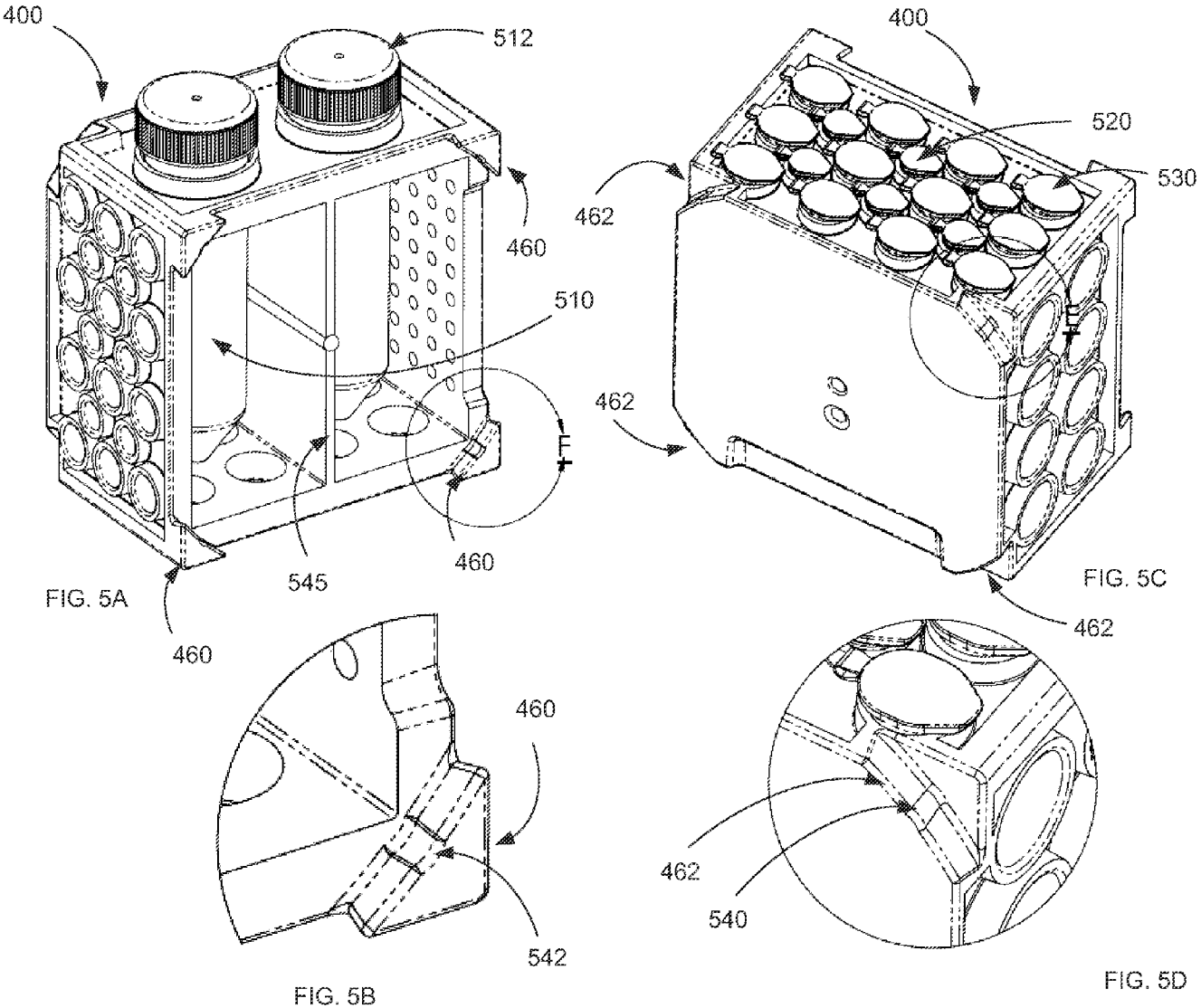
FIGS. 5A-5D show perspective views of an exemplary embodiment.

FIGS. 5A-5D show perspective views of an exemplary embodiment. Two views of rack module 400 are shown in a fashion that illustrates engagement features 460 and matching engagement features 462, with the rack modules 400 in different receptacle orientations. FIG. 5B is an enlarged view of a portion of the rack module 400 shown in FIG. 5A. FIG. 5D is an enlarged view of a portion of the rack module 400 shown in FIG. 5B.

FIG. 5B illustrates divot 542, which in this example is associated with engagement feature 460. FIG. 5D illustrates protuberance 540, which in this example is associated with complementary engagement feature 462.

FIG. 5A illustrates rack module 400 in an orientation having two containers 510 disposed therein. In this example, each container 510 includes a cap 512. In some embodiments, a spacing between receptacles may be sufficient that a cap may be attached to (or removed from) a container disposed therein. FIG. 5C shows a different orientation, and includes two types of receptacles shaped for two different containers 520 and 530, each having integrated caps.

Certain embodiments may include a rib 545, which may provide additional structural support to the rack module. In some aspects, rib 545 is orthogonal to a side configured to receive large containers (e.g., containers 510), which may allow these containers to descend to the opposite side of the rack module.

Figure 6A:
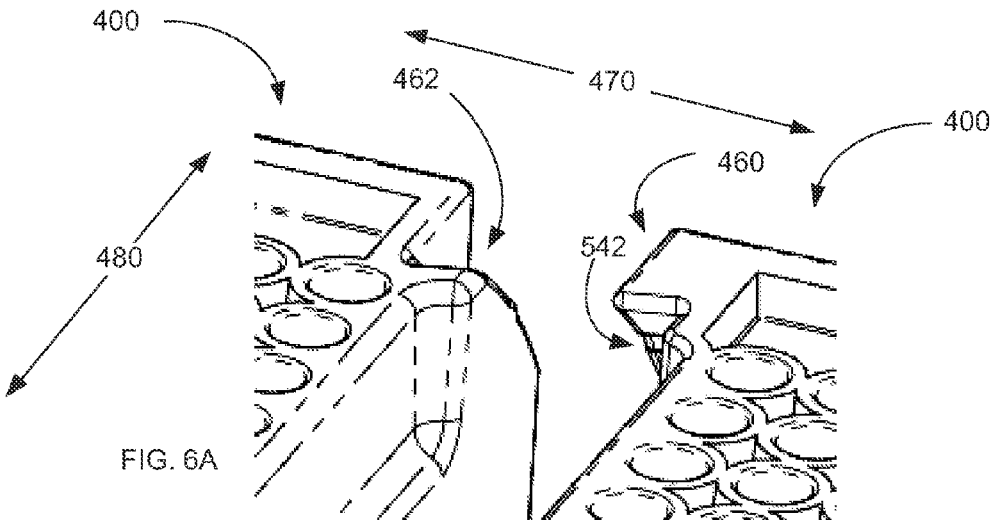
FIGS. 6A-6B show perspective views of a portion of an exemplary rack module, according to certain embodiments.
Figure 6B:
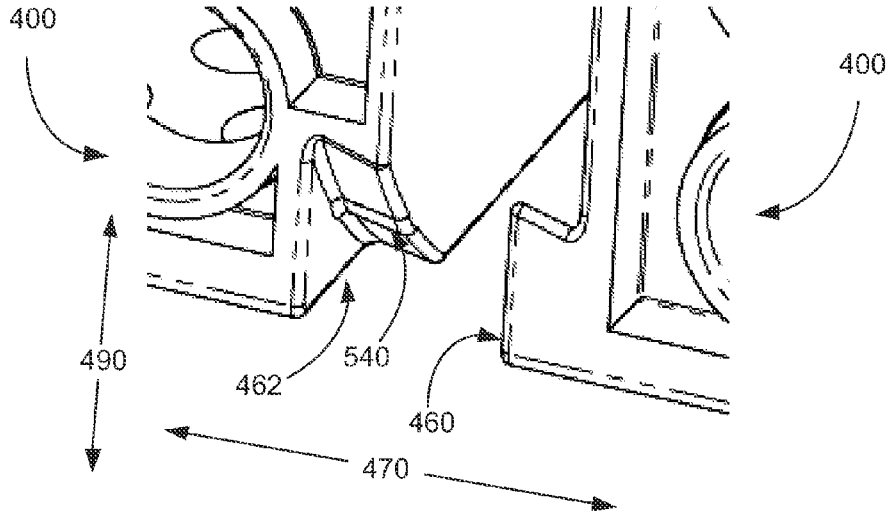

FIG. 6A-6B show perspective views of a portion of a rack module, according to certain embodiments. FIGS. 6A and 6B show different perspective views of complementary engagement features 460 and 462 associated with two adjacent (but not attached) rack modules 400. Engagement features 460/462 may prevent relative lateral displacement of attached rack modules in directions 480, 490, and optionally in direction 470. In embodiments for which engagement features 460/462 prevent lateral displacement in directions 470, 480, and 490, attached rack modules may be disengaged by applying a torque about axis 470, typically with sufficient force to elastically flex the engagement features. Continued rotation of the adjacent rack modules may then allow for clearance of the engagement features past each other, providing for separation of the rack modules.

Figure 7:
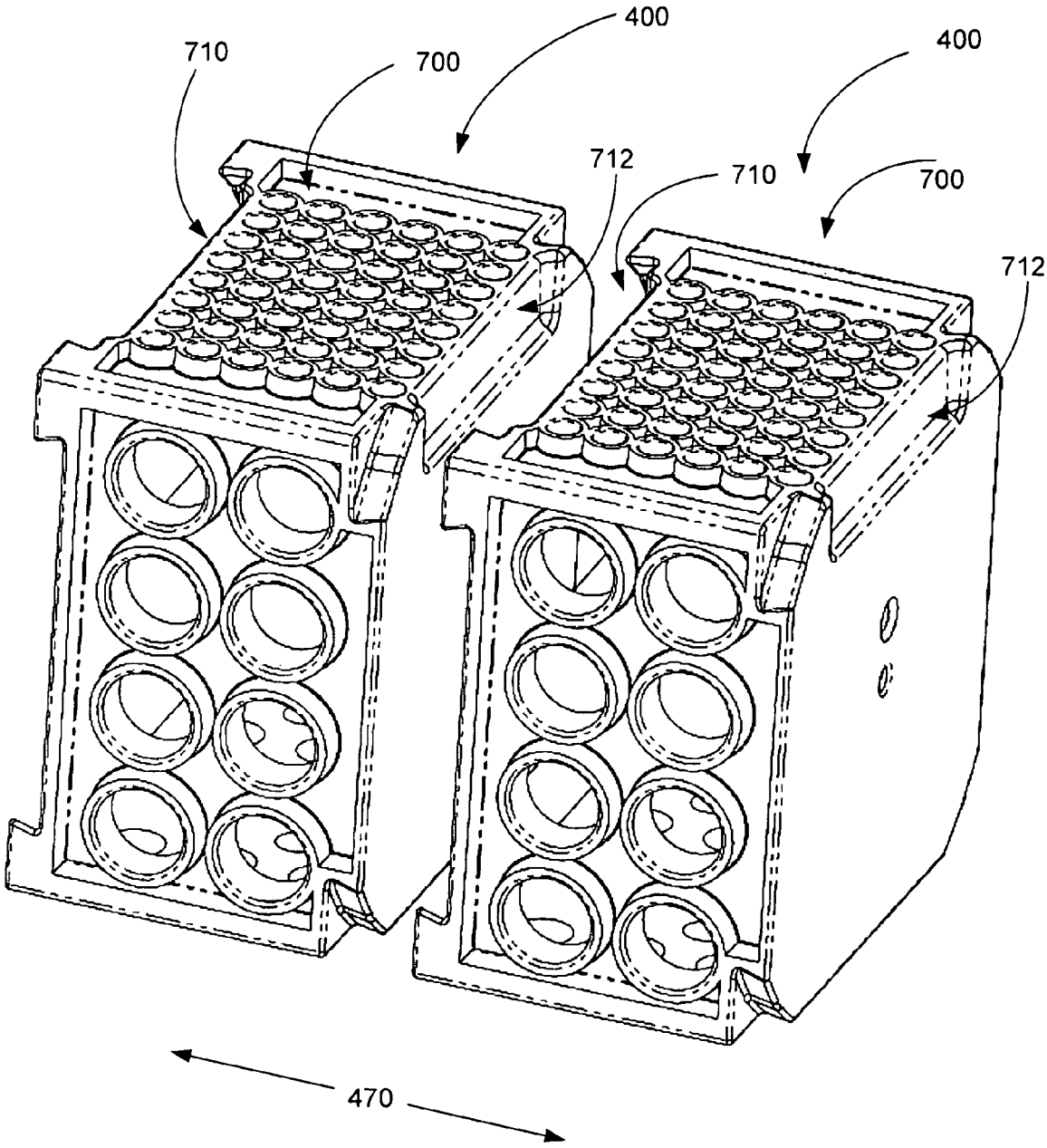
FIG. 7 shows two exemplary unattached rack modules having matched partial receptacles, according to various embodiments.

FIG. 7 shows two exemplary unattached rack modules having matched partial receptacles, according to various embodiments. Each rack module 400 includes a side 700 having an array of receptacles configured to receive an array of containers, a partial receptacle 710, and a matching partial receptacle 712. A partial receptacle may be incorporated into a surface, corner, edge, or other structural feature of a rack module. A partial receptacle may include at least a portion of a contact surface, designed to receive and hold at least a portion of a container. Rack modules 400 may be attached in a configuration shown, such that attached rack modules having matched partial receptacles form a receptacle by the combination of the two matched partial receptacles.

Figure 8:
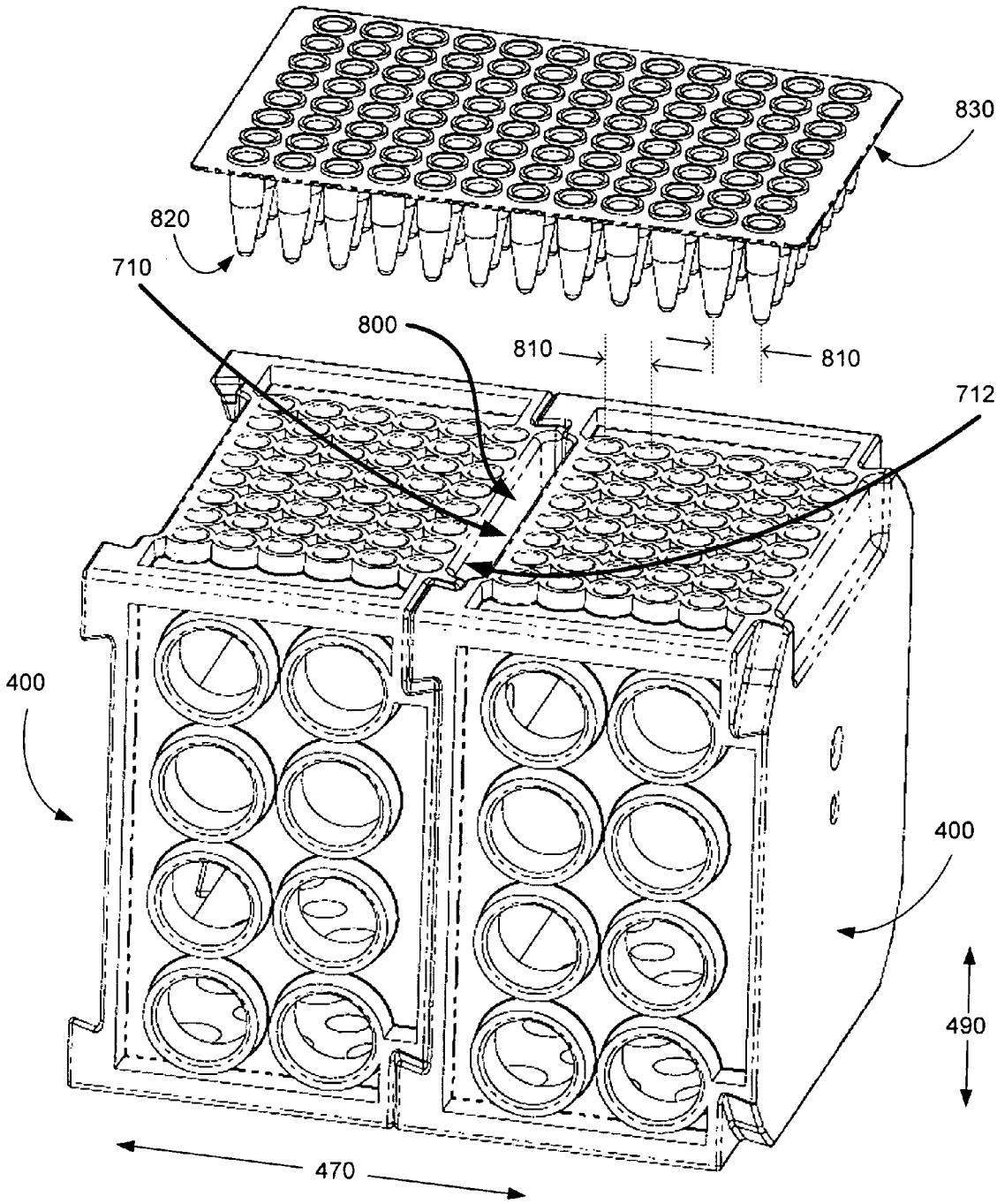
FIG. 8 illustrates two exemplary attached rack modules, with a receptacle formed by the matching of two complementary partial receptacles.

FIG. 8 illustrates two exemplary attached rack modules, with a receptacle formed by the matching of two complementary partial receptacles. The matched partial receptacles 710 and 712 of attached rack modules 400 form receptacle 800. In some cases, receptacles may be characterized by a spacing 810, and a partial receptacle may be spaced such that a pair of matched partial receptacles form a receptacle characterized by the same spacing 810 with respect to an adjacent receptacle.

In some embodiments, and as shown in FIG. 8, spacing 810 corresponds to an inter-receptacle spacing that matches the spacing between containers 820, and receptacle 800 also matches this spacing. Such a configuration may allow two or more attached rack modules to receive and hold an array of containers (e.g., array 830) that is larger than a single rack module. For example, the matched pair of attached rack modules 400 shown in FIG. 8 may receive array 830 as shown. In some embodiments, array 830 includes a PCR plate, and spacing 810 is matched to the inter-container spacing associated with the plate.

Figure 9:
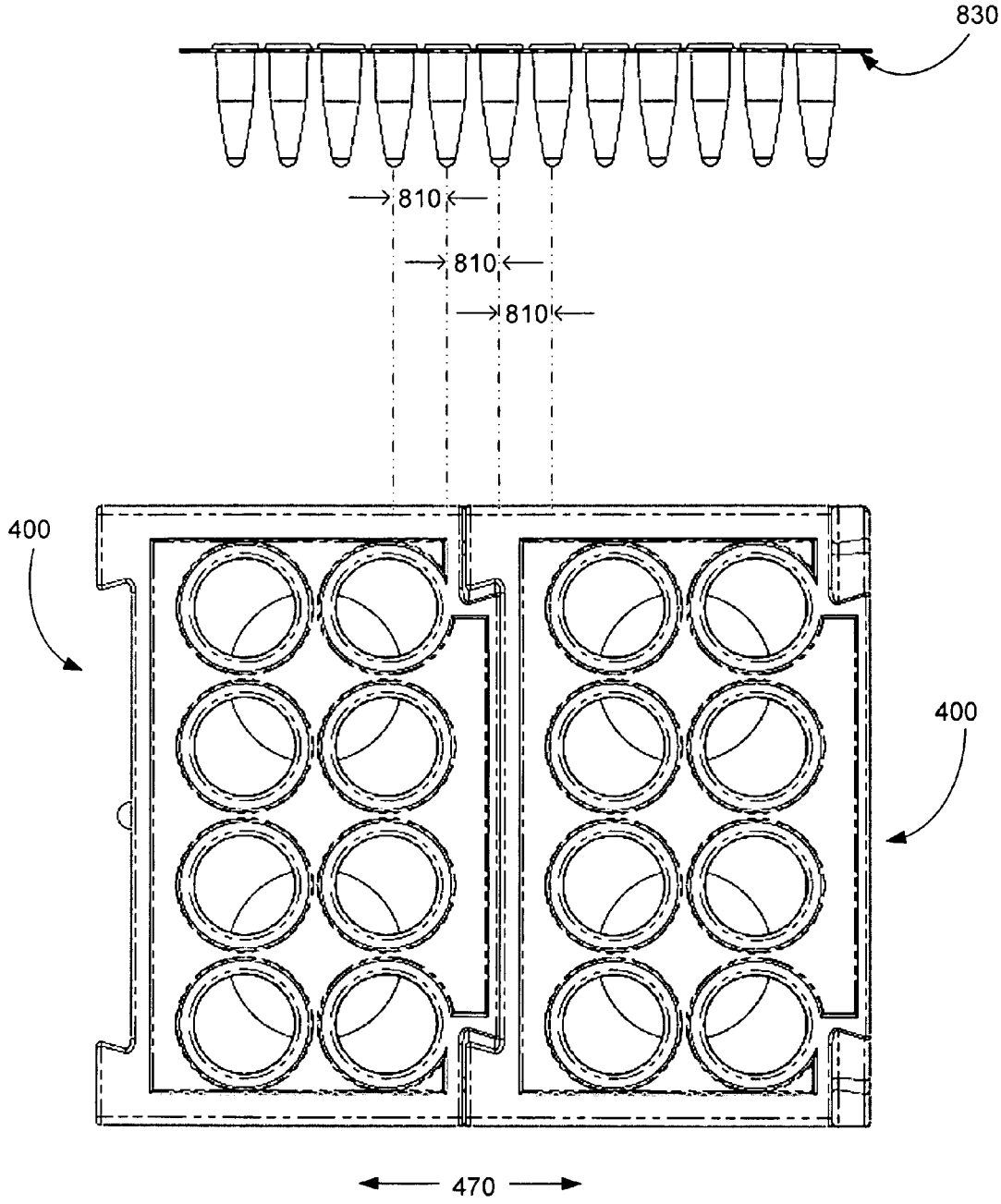
FIG. 9 illustrates an alternate view of an exemplary pair of attached rack modules, according to some embodiments.

FIG. 9 illustrates an alternate view of an exemplary pair of attached rack modules, according to some embodiments. FIG. 9 illustrates an elevation view of the attached rack modules 400 shown in FIG. 8. Attached rack modules 400 include matching partial receptacles 710/712 (which are oriented facing "up" in this illustration, see FIG. 8). These matched partial receptacles form a receptacle 800 (FIG. 8) characterized by spacing 810 with respect to other receptacles on the top surface of the rack modules. Spacing 810 substantially matches the inter-container spacing associated with array 830. Thus, the pair of attached rack modules 400 having matched partial receptacles may receive array 830 as shown.

Figure 10:
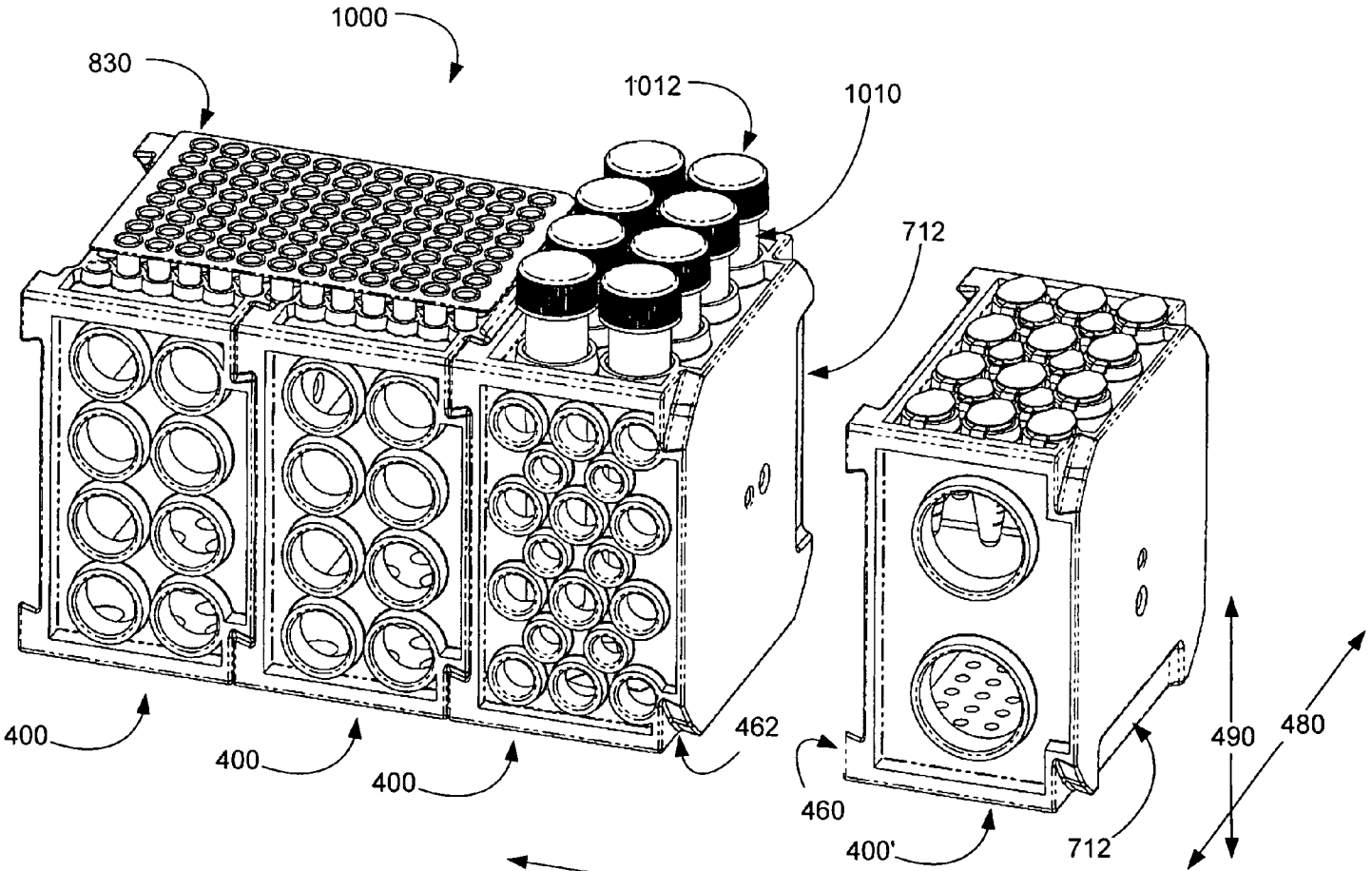
FIG. 10 illustrates an exemplary rack comprising several rack modules, according to certain embodiments.

FIG. 10 illustrates an exemplary rack comprising several rack modules, according to certain embodiments. Rack 1000 includes three rack modules 400, attached in an attachment direction 470. Rack 1000 includes a pair of attached rack modules with matching partial receptacles, configured to receive array 830. Rack 1000 also includes a rack module oriented to receive containers 1010, shown with caps 1012.

FIG. 10 also illustrates a rack module 400' that is not attached to the rack modules of rack 1000. This illustration shows different rotational configurations of rack modules 400, as shown by different positions of partial receptacles 712 as compared to the rack module 400 containing containers 1010. Different orientations between sides, receptacles, and partial receptacles are also possible. In some embodiments, rack module 400' may be attached to rack 1000 by rotating it (e.g., 45 degrees) about direction 470, bringing rack module 400' into contact with rack 1000 (i.e., moving in direction 470), and rotating it back, applying sufficient torque that engagement features 460 engage with complementary engagement features 462. Racks such as rack 1000 may be customized to various lengths by adding or removing rack modules. Racks may also be customized by changing the configurations of the rack modules. In some embodiments, racks such as rack 1000 do not include hardware or apparatus other than rack modules, and each rack module may be fabricated from a single piece of material. In such cases, cleaning a rack may be facilitated by disengaging the rack modules.

Figure 11B:
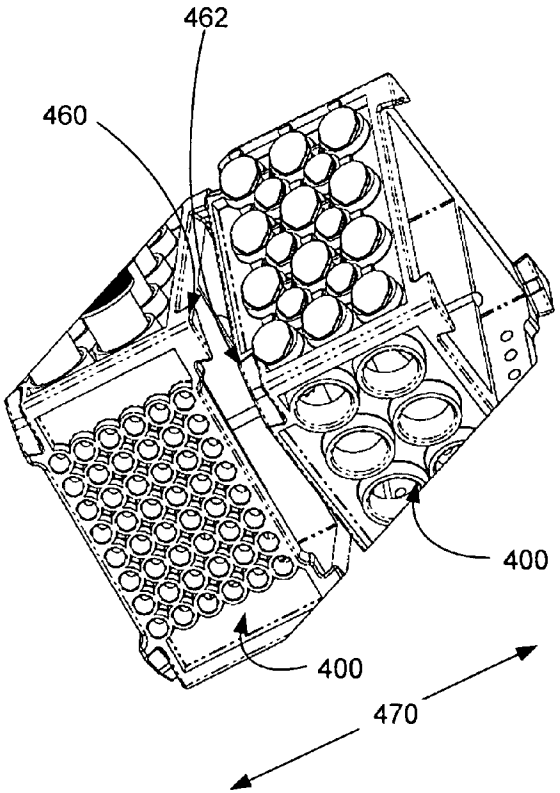
FIGS. 11A and 11B illustrate operation of an exemplary engagement feature using rotation.
Figure 11A:
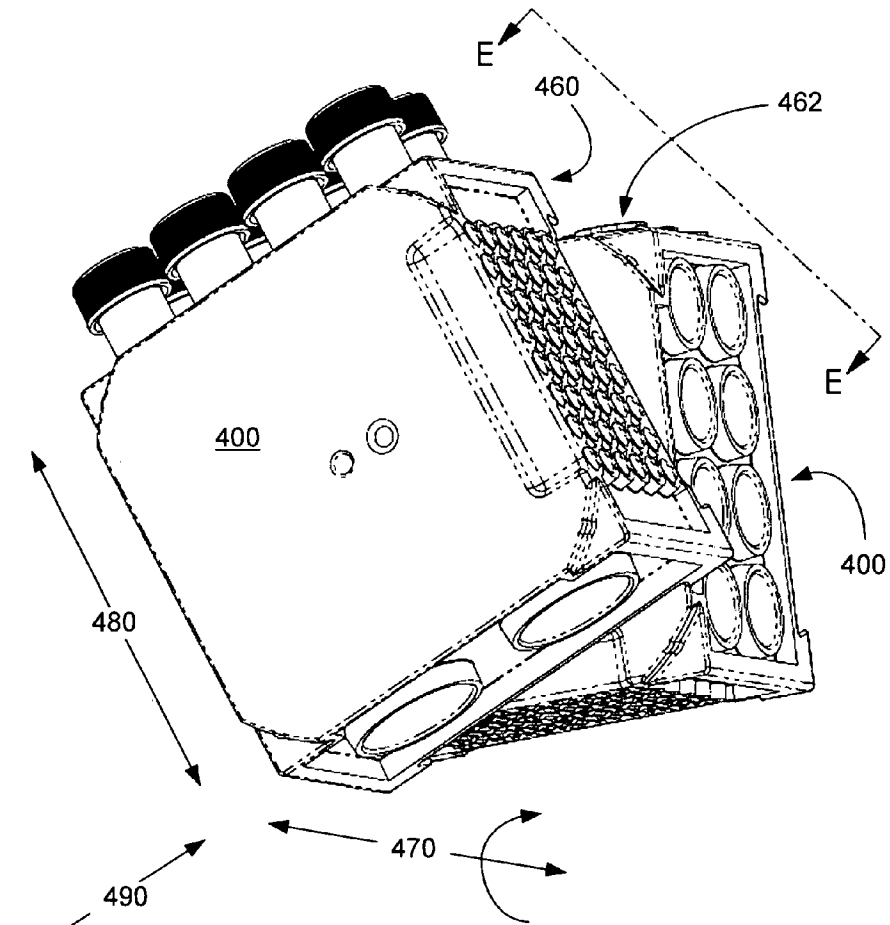

FIGS. 11A and 11B illustrate operation of an exemplary engagement feature using rotation. In some embodiments, rotation may be used to attach and disengage rack modules. The view annotated "Section E-E" in FIG. 11B is associated with the viewpoints E-E shown in FIG. 11A, as is typically done in mechanical drawing. Rack modules 400 may be angularly disposed as shown in FIG. 11A, and their respective sides may be brought together. FIG. 11B shows another view of two such rack modules 400, slightly spaced apart to improve clarity. Attachment may entail bringing the adjacent rack modules together until they contact each other, then rotating them with respect to each other (about axis 470) until the various engagement features 460 engage with their corresponding matching engagement features 462.

An opposite rotation may be used to disengage the attached rack modules 400 from each other. A rotational attachment/disengagement mechanism may provide for racks that are resistant to disengagement by other forces (e.g., linear forces). In some embodiments, attached rack modules resist disengagement by a linear force between attached rack modules 400 in directions 470, 480, or 490, which may provide for a sturdy rack, resistant to various forces that may be encountered during use, notwithstanding that it may be separated into discrete rack modules using an appropriate force in or about a predefined direction.

The present invention is described above with reference to exemplary embodiments. It will be apparent to those skilled in the art that various modifications may be made and other embodiments can be used without departing from the broader scope of the present invention.

What is claimed is:

1. A rack for holding a plurality of containers, the rack comprising two or more removably attached rack modules, each rack module including:

a side including one or more receptacles, each receptacle having a contact surface shaped to receive a container; and one or more engagement features located on a support structure of the rack module, the one or more engagement features operable to removably attach the rack module to one or more complementary engagement features of a second rack module, wherein the engagement feature of the first rack module includes a protuberance that extends from a surface of the engagement feature and fits into a divot of the complementary engagement feature of the second rack module for improved attachment and detachment, and wherein the attached rack module and the second rack module are commonly oriented to receive containers therein and wherein the one or more engagement features interfittingly mate and attach with the one or more complementary engagement features; and wherein the side includes a partial receptacle having a shape configured to form a receptacle in combination with a matching partial receptacle when the rack module is attached to the second rack module having the matching partial receptacle; and wherein the engagement features are integrated with one or more corners of the rack module.

2. The rack of claim 1, wherein the side includes a plurality of receptacles arranged in an array having a spacing.

3. The rack of claim 2, wherein the shape of the partial receptacle is such that a receptacle formed from a pair of matching partial receptacles is separated from a member of the plurality by the spacing.

4. The rack of claim 2, wherein the spacing is between 5 and 25 millimeters.

5. The rack of claim 2, wherein the spacing is between 7 and 12 millimeters.

6. The rack of claim 2, wherein the spacing corresponds to a distance between wells of a PCR plate.

7. The rack of claim 1, wherein a receptacle is sized to receive a test tube, a vial, a beaker, a flask, or a bottle.

8. The rack of claim 1, wherein a receptacle has a diameter between about 1 cm and 15 cm.

9. The rack of claim 1, wherein a receptacle has a diameter between 3 mm and 3 cm.

10. The rack of claim 1, wherein the contact surface is adapted to receive a body having a plurality of containers disposed therein.

11. The rack of claim 10, wherein the body includes a microtiter plate.

12. The rack of claim 1, wherein the contact surface constrains the received container against rotation.

13. The rack of claim 1, further comprising a second side, wherein an angular relationship between vectors normal to the first and second sides is between about 20 and 180 degrees.

14. The rack of claim 13, wherein the first side is opposite the second side.

15. The rack of claim 1, wherein the one or more receptacles include first receptacles which locate their respective containers at a first height when the rack module is oriented for using the first receptacles, and second receptacles which locate their respective containers at a second height when the rack module is oriented for using the second receptacles.

16. The rack of claim 15, wherein the first height equals the second height.

17. The rack of claim 1, wherein the engagement features are adapted to remove the first rack module from the second rack module by the application of a force in a first direction.

18. The rack of claim 17, wherein the engagement features of the first rack module resist the removal of the first rack module from the second rack module when a force is exerted in a plurality of second directions other than the first direction.

19. The rack of claim 17, wherein the force in the first direction includes a torque about an axis parallel to a direction of attachment between the attached rack modules.

20. The rack of claim 1, wherein an engagement feature includes a dovetail having a retention direction.

21. The rack of claim 20, wherein the dovetail has a plurality of retention directions.

* * * * *